US010443804B2

(12) United States Patent
Kuepper et al.

(10) Patent No.: US 10,443,804 B2
(45) Date of Patent: Oct. 15, 2019

(54) VEHICLE HEADLIGHT WITH TWO FILAMENTS AND MOUNTING OF SUCH A LAMP WITHIN A REFLECTOR

(71) Applicant: Lumileds LLC, San Jose, CA (US)

(72) Inventors: Lukas Kuepper, Aachen (DE); Bernd Schoenfelder, Aachen (DE); Kang Lu, Shanghai (CN); Ping Wu, Shanghai (CN)

(73) Assignee: LUMILEDS LLC, San Jose, CA (US)

( * ) Notice: Subject to any disclaimer, the term of this patent is extended or adjusted under 35 U.S.C. 154(b) by 0 days.

(21) Appl. No.: 16/306,303

(22) PCT Filed: May 23, 2017

(86) PCT No.: PCT/EP2017/062421
§ 371 (c)(1),
(2) Date: Nov. 30, 2018

(87) PCT Pub. No.: WO2017/207354
PCT Pub. Date: Dec. 7, 2017

(65) Prior Publication Data

US 2019/0128493 A1 May 2, 2019

(30) Foreign Application Priority Data

Jun. 3, 2016 (WO) ..... PCT/CN2016/084632
Jun. 29, 2016 (EP) ..... 16176805

(51) Int. Cl.
*F21S 41/33* (2018.01)
*H01K 1/14* (2006.01)
(Continued)

(52) U.S. Cl.
CPC ..... *F21S 41/332* (2018.01); *F21S 41/164* (2018.01); *F21S 41/19* (2018.01); *F21S 41/194* (2018.01);
(Continued)

(58) Field of Classification Search
None
See application file for complete search history.

(56) References Cited

U.S. PATENT DOCUMENTS 4,480,296 A * 10/1984 Gagnon ..... H01K 9/08 313/115
6,281,630 B1 * 8/2001 English ..... F21S 41/164 313/635
2016/0148798 A1 * 5/2016 Kowalski ..... F21S 41/125 362/516

FOREIGN PATENT DOCUMENTS

DE 102009039786 A1 3/2011
EP 0989354 A2 3/2000
(Continued)

*Primary Examiner* — Britt D Hanley
(74) *Attorney, Agent, or Firm* — Volpe and Koenig, P.C.

(57) ABSTRACT

The invention relates to a headlight for a vehicle, comprising a concave reflector and a lamp arranged within the reflector to reflect light from the lamp to create an illumination beam with a bright/dark boundary. The lamp comprises a transparent vessel including a longitudinal axis, at least a first and second filament arranged within the vessel. A baffle arranged proximate to the first filament, and comprising first and second upper side edges. The first filament is arranged above a plane including the upper side edges. A different plane is through the center of the first filament and is arranged perpendicular to the longitudinal axis. The upper side edges are arranged symmetrically to a baffle symmetry axis extending from the center of the first filament centrally between the upper side edges. The lamp is arranged within the reflector rotated around said longitudinal axis by a rotation angle of 2°-20°.

13 Claims, 6 Drawing Sheets

(51) Int. Cl.

| | |
|---|---|
| ***H01K 9/08*** | (2006.01) |
| ***F21S 41/19*** | (2018.01) |
| ***F21S 41/164*** | (2018.01) |
| ***F21S 41/43*** | (2018.01) |
| ***H01K 1/26*** | (2006.01) |

(52) U.S. Cl.
CPC ..... *F21S 41/43* (2018.01); *F21S 41/435* (2018.01); *H01K 1/14* (2013.01); *H01K 1/26* (2013.01); *H01K 9/08* (2013.01)

(56) References Cited

FOREIGN PATENT DOCUMENTS

| | | | |
|---|---|---|---|
| EP | 2426406 | A2 | 3/2012 |
| JP | 2000306405 | A | 11/2000 |
| JP | 2003059317 | A | 2/2003 |
| JP | 2008041545 | A | 2/2008 |
| WO | 2014/207112 | A1 | 12/2014 |

* cited by examiner

VEHICLE HEADLIGHT WITH TWO FILAMENTS AND MOUNTING OF SUCH A LAMP WITHIN A REFLECTOR

FIELD OF THE INVENTION

The invention relates to a headlight for vehicles, to a reflector for a headlight and to a method of forming an illumination beam for a vehicle.

BACKGROUND OF THE INVENTION

Headlights for motor vehicles create an illumination beam projected forward of the vehicle to illuminate the road. In order to avoid glare for oncoming traffic, the intensity distribution of the illumination beam for low beam light comprises a bright/dark boundary. Regulations pertain to the specific required shape of the bright/dark boundary, which generally includes a horizontal portion and an inclined portion.

Different lamps of the incandescent type exist for motor vehicle headlights. While some lamps only comprise a single filament as light-emitting element, other lamps, such as e.g. H4, comprise two filaments and a baffle arranged proximate to a first filament to partially shield light emitted therefrom. With such two-filament types of lamps, both high beam and low beam function may be achieved by the same lamp and reflector.

Examples of known two-filament lamps are H4, HS1, and the newly proposed H19.

WO2014207112A1 discloses such a two-filament lamp for a vehicle headlight, with the filaments in a transparent lamp vessel with a partial color filter for coloring a peripheral and/or a scattered portion of light of the lamp while leaving the lamp's illumination beam uncolored.

SUMMARY OF THE INVENTION

It may be considered an object to propose a headlight and a reflector as well as a method of forming an illumination beam in a way to avoid or minimize glare for oncoming traffic.

According to an aspect of the invention, a headlight according to claim 1 is proposed. According to a further aspect, a reflector according to claim 12 is proposed. The method of claim 13 relates to a still further aspect of the invention. Dependent claims refer to preferred embodiments.

The present inventors have considered use of lamps with symmetrical arrangement of the baffle relative to a first filament, wherein the first filament is arranged above a plane including side edges of the baffle. While a lamp of this design provides more light than lamp types with a first filament closer to the baffle, the inventor has determined that a symmetrical, horizontal arrangement of the lamp in a reflector may lead to glare by stray light. Stray light may occur due to scattering at the inner wall of the baffle and reflection at the side edges. Surprisingly, the inventors have found that glare can be reduced by arranging the lamp rotated within the reflector by a certain rotation angle.

According to an aspect of the invention, a headlight for a vehicle comprises a concave reflector and a lamp arranged within the reflector. Light emitted from the lamp is reflected at the reflector surface to create an illumination beam of desired properties.

The lamp is an incandescent, preferably halogen lamp including a sealed transparent vessel with a longitudinal axis and at least a first and second filament arranged within the vessel. Preferably, at least the portion of the vessel surrounding the filaments is cylindrical, such that the longitudinal axis may be the central longitudinal axis of the cylindrical portion.

Proximate to the first filament, a baffle is arranged to partially shield light emitted from the first filament. The baffle is preferably of concave shape and extends along the longitudinal axis for at least the length of the first filament. At least a front portion of the baffle may be arranged in between the first and second filaments.

The baffle may serve to partially shield light emitted from the first filament, such that the light emitted from the first filament which is not shielded may be reflected to form an illumination beam including a bright/dark boundary, in particular a low beam. The second filament is preferably unshielded and may serve to create a high beam, which does not comprise a bright/dark boundary.

The baffle comprises first and second upper side edges extending longitudinally, at least in a side view. Preferably, the upper side edges have at least a straight portion (in side view) extending in parallel to the longitudinal axis over the length of the first filament. The first filament is arranged above the upper side edges of the baffle, i.e. above a plane including the upper side edges (or at least the above defined straight portions thereof). In particular, the lower side of the first filament may be arranged at a distance to the plane of the edges, such as e.g. a distance of 0.1 mm or more, preferably 0.3 mm or more. In the lamp according to this aspect of the invention, the first filament is thus arranged relatively high above the baffle as compared to lamps such as the H4 and HS1, thus providing more light which is emitted unshielded.

According to an aspect of the invention, the arrangement of the upper side edges of the baffle is symmetrical. In a central transversal plane, i.e. a plane arranged perpendicular to the longitudinal axis running through the center of the first filament, a baffle symmetry axis may be defined from the center of the first filament centrally between the upper side edges.

According to an aspect of the invention, the lamp is arranged within the reflector rotated around its longitudinal axis by a rotation angle of 2-20° with respect to a horizontally symmetrical arrangement. Further preferably, the rotation angle may be at least 4°. Particularly preferable is a rotation angle of 6-18°. Preferably, the lamp may be arranged within the reflector such that the baffle symmetry axis is arranged rotated relative to a vertical axis by the rotation angle.

Arrangement of the lamp in the thus specified rotation position has surprisingly proven to allow concepts with greatly reduced glare, in particular in the most significant portions of the illumination beam. As will become apparent in connection with preferred embodiments, rotation of the lamp leads to different optical effects for the beam portions emitted horizontally: Viewed from the side of the lamp in the horizontal direction towards which the lamp is rotated, the closer upper side edge of the baffle appears lower relative to the filament, whereas viewed from the opposite horizontal side the other upper side edge appears higher, such that it may shield the filament partially or even fully. These different effects allow to use a corresponding reflector avoiding stray light being emitted into critical portions of the illumination beam.

According to an aspect of the invention, the lamp may comprise a base with radially extending positioning protrusions. The positioning protrusions may be arranged symmetrically relative to a protrusion symmetry axis, which is arranged parallel to the baffle symmetry axis. Thus, the lamp may be fully symmetrical both with regard to the positioning protrusions and to the relative arrangement of the baffle and first filament. Particularly preferred are lamps with three radially extending positioning protrusions, one in parallel to the protrusion symmetry axis.

The reflector provided according to a separate aspect on the invention comprises a concave reflector surface forming an inner reflector space. An opening is provided for arrangement of a lamp including positioning protrusions, for example as explained above. The reflector comprises receiving portions for the positioning protrusions which are located at the reflector such that the lamp, if the positioning protrusions are received in the respective receiving portions, is positioned in the above described rotating position under the desired rotation angle.

According to a preferred aspect, the reflector may be a complex shape reflector comprising a plurality of reflecting segments, each arranged to project images of at least one of the filaments. A complex shape reflector may use the separate reflecting segments of the reflector surface to form a desired illumination beam from a superposition of individual filament images.

According to a preferred aspect, the lamp may be arranged within the reflector such that viewed in horizontal direction from a first side the first filament is at least partially shielded by the first upper side edge of the baffle, and viewed in opposite horizontal direction from a second, opposite side the second upper side edge of the baffle is arranged not to shield the first filament. Thus, while a horizontally symmetrical orientation of the first filament and the baffle (0° rotation) would lead to the same filament image and same amount of light at both horizontal directions, the rotated and thus asymmetrical arrangement allows the opposite horizontal portions of the reflector surface to receive light from the first filament differently.

As already mentioned, regulations for the illumination beam of vehicle headlights in different countries provide a shape of a bright/dark boundary for low beam light including a horizontal portion and an inclined portion. Particularly, the inclined portion may be arranged under an angle of e.g. 15° relative to the horizontal. According to a preferred aspect, the reflector may comprise one or more first reflecting segments on a first side arranged at least substantially in horizontal direction from the first filament. The first reflecting segment may be arranged to reflect light from the first filament to a horizontal portion of a bright/dark boundary of the illumination beam. One or more second reflecting segments of the reflector may be arranged on a second side, opposite to the first side, in at least substantially horizontal direction from the first filament. The second reflecting segment may be arranged to reflect from the first filament to an inclined portion of the bright/dark boundary of the illumination beam. Thus, reflecting segments of the reflector arranged at opposite sides may be provided to direct light into different portions of the illumination beam.

Generally, the inclined portion of the bright/dark boundary will be more critical with respect to glare as compared to the horizontal portion. For this reason, it is preferred to arrange the lamp in such a rotated position that one or more second reflecting segments are illuminated by an at least partially shielded first filament rather than by the first filament fully visible and arranged at a distance to the corresponding upper side edge of the baffle, because this may lead to scattered light being reflected by the first reflecting segments.

According to a further preferred aspect, the second reflecting segment, arranged to reflect light from the first filament to an inclined portion of the bright/dark boundary, may be shaped to have a focus located on the upper edge, rather than on the first filament. This may serve to obtain a sharp projection of the upper edge of the baffle located closest to it, onto the inclined portion of the bright/dark boundary.

According to another preferred aspect of the invention, the first reflecting segment, arranged to reflect light from the first filament to a horizontal portion of the bright/dark boundary, may be shaped to have a focus located on the first filament, rather than on the corresponding upper side edge of the baffle.

The preferred type of lamp to be used in the headlight and method according to the invention may have an electrical power of more than 60 W for both the first and second filament (measured at a supply voltage of 13.2 V). Preferably, the first filament is disposed to operate at an electrical power of 62-68 W and the second filament at 64-72 W at the specified supply voltage. In operation of the first filament, the lamp may preferably emit light with a luminous flux of 1080-1320 lm, most preferably 1150-1250 lm. In operation of the second filament, the lamp may emit light with a luminous flux of 1630-1870 lm, preferably 1700-1800 lm.

These and other aspects of the invention will become apparent from and elucidated with reference to the embodiments described hereinafter.

DETAILED DESCRIPTION OF EMBODIMENTS

Figure 1:
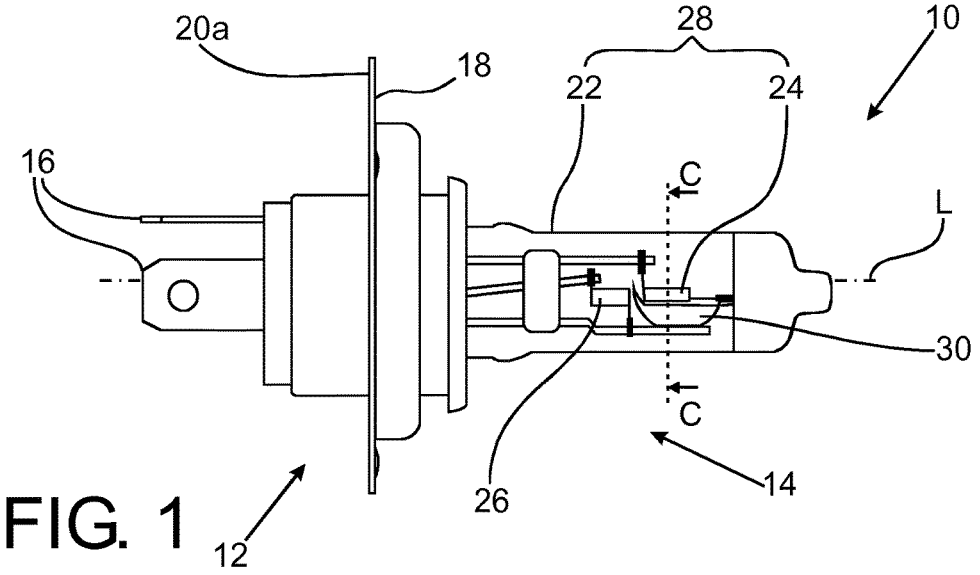
FIG. 1, 2 show a side view and a back view of a two-filament lamp.
Figure 2:
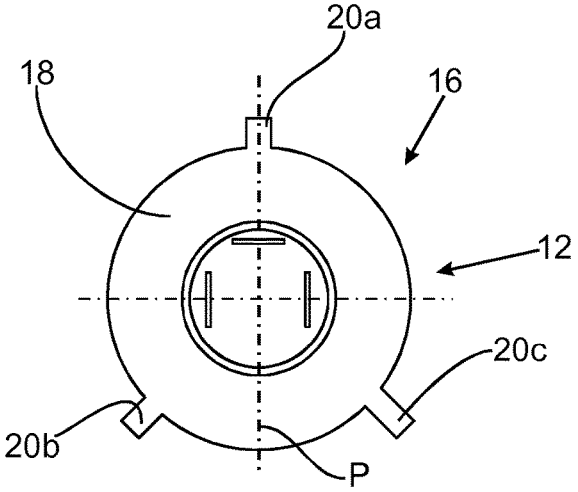
Figure 3:
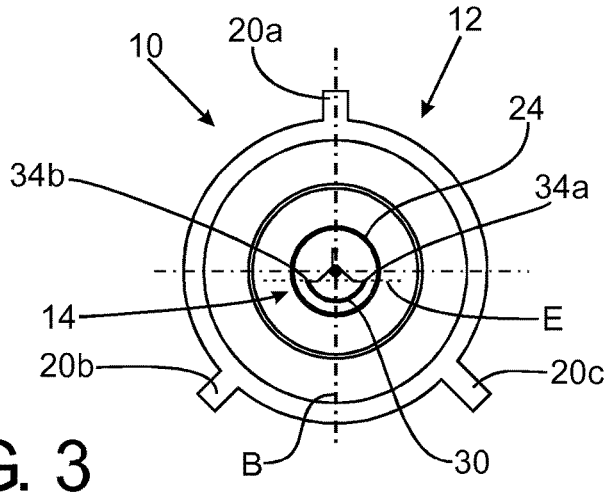
FIG. 3 shows a sectional view of the lamp of FIG. 1, 2 with the section along the line C . . . C in FIG. 1.

FIGS. 1, 2, 3 show a two-filament halogen incandescent lamp 10, for example of the H19 type. The lamp 10 comprises a base 12 and a burner 14. The base 12 comprises electrical contacts 16 and mechanical reference elements for mounting of the lamp including a positioning ring 18 and protruding therefrom in radial directions three positioning protrusions 20*a*, 20*b*, 20*c*.

The burner 14 is fixed to the base 12 and comprises a transparent vessel 22. A first filament 24 and a second filament 26 are arranged within a cylindrical portion 28 of the transparent vessel 22. A longitudinal axis L is defined as the center of the cylindrical portion of the vessel 22.

The filaments 24, 26 are arranged within the vessel 22 mounted on mounting rods. A baffle 30 is mounted on one of the mounting rods in a position proximate to the first filament 24.

Figure 4:
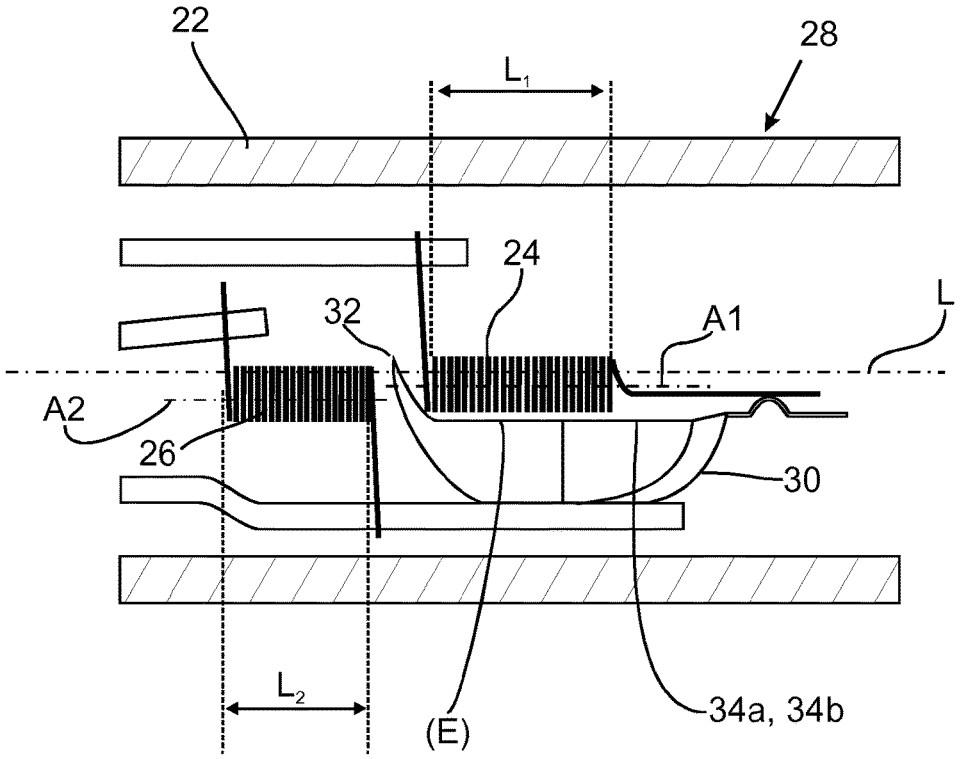
FIG. 4 shows an enlarged side view of a portion of a burner of the filament lamp of FIGS. 1-3.

The relative arrangement of the first and second filaments 24, 26 and the baffle 30 within the cylindrical portion 28 of the vessel 22 are shown in FIG. 4. Both filaments 24, 26 are provided as single winding structures of filament wire wound around respective straight filament axes A1, A2 extending parallel to the longitudinal axis L.

In the example, the first filament 24 has an axial length L1 of about 5 mm and the second filament 26 has an axial length L2 of about 4 mm. The outer diameter of the winding structure of the first filament 24 in the example may be 1.4 mm and the outer diameter of the winding structure of the second filament 26 in the example may be 1.6 mm.

The baffle 30 arranged proximate to the first filament 24 comprises a front portion 32 arranged between the first and second filament 24, 26 which are thus optically shielded from one another.

The baffle 30 is of concave shape and comprises left and right upper side edges 34*a*, 34*b*. In the side view shown in FIG. 1, FIG. 4, the upper side edges 34*a*, 34*b* extend straight and in parallel to the longitudinal axis L. A straight portion of the upper side edges 34*a*, 34*b* is arranged parallel along the length L1 of the first filament 24. As the skilled person will appreciate, the upper side edges 34*a*, 34*b* may have a curvature in a horizontal plane (not shown).

The baffle 30 serves to partially shield light emitted from the first filament 24, in particular light emitted into radial directions below the upper side edges 34*a*, 34*b*. If the lamp 10 is mounted in a reflector 40 of a vehicle headlight 50 as shown in FIG. 5, the second filament emits light to be reflected both at upper and lower portions of the reflector 40 (dashed lines) for forming a high beam, whereas the first filament 24 emits light only to be reflected at upper portions of the reflector 40 (dotted lines) for forming a low beam 42.

In the lamp shown, the first filament 24 is arranged relatively high above the baffle 30. A plane E (FIG. 3) may be defined by the upper side edges 34*a*, 34*b*. The first filament 24 is arranged above the plane E, such that in a side view (FIG. 4) the full filament 24 can be seen above the respective side edge 34*a*, 34*b* of the baffle 30, with a distance of e.g. some 0.3 mm between the lower side of the first filament 24 and the upper side edges 34*a*, 34*b*.

The lamp 10 is fully symmetrical, both with respect to the base 12 and to the burner 14. As shown in the back view of FIG. 2, the positioning protrusions 20*a*, 20*b*, 20*c* are arranged symmetrically to a protrusion symmetry axis P shown vertically. Likewise, the arrangement of the first filament 24 and the baffle 30 as shown in the section view of FIG. 3 is symmetrical to a baffle symmetry axis B also shown vertically. The baffle symmetry axis B and the protrusion symmetry axis P are arranged in parallel.

Figure 5:
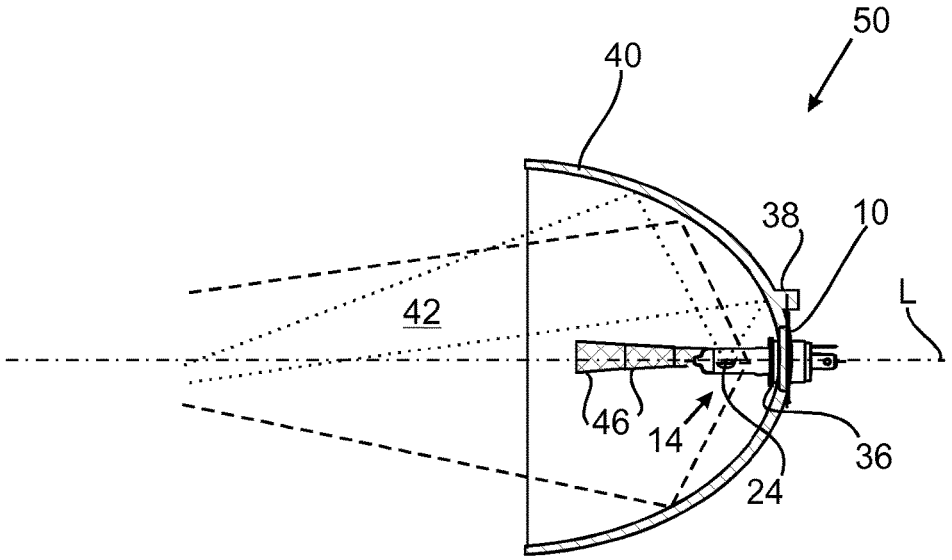
FIG. 5 shows a schematical sectional view of an embodiment of a headlight.

The lamp 10 may be inserted into a reflector 40 of a vehicle headlight 50 as schematically shown in the sectional view of FIG. 5. The lamp 10 is inserted in a back opening 36 of the reflector 40 such that the burner 14 is arranged in the inner reflector space. The lamp 10 is positioned within the reflector 40 by the mechanical reference elements 18, 20*a*, 20*b*, 20*c* being received in corresponding stopping positions around the mounting opening 36. In particular, the rotational position of the lamp 10 with respect to the longitudinal axis L is determined by the positioning protrusions 20*a* 20*b*, 20*c* being received in corresponding receiving portions 38 at the reflector 40.

Light from the first filament 24 is reflected by the inner reflective surface of the reflector 40 to form an illumination beam 42 including a bright/dark boundary suitable for low beam lighting.

The reflector 40 is a complex shape reflector comprising individually shaped reflector segments, some of which are shown in FIG. 5 as 46. The illumination beam 42 is created as a superposition of images of the first filament 24.

Figure 6:
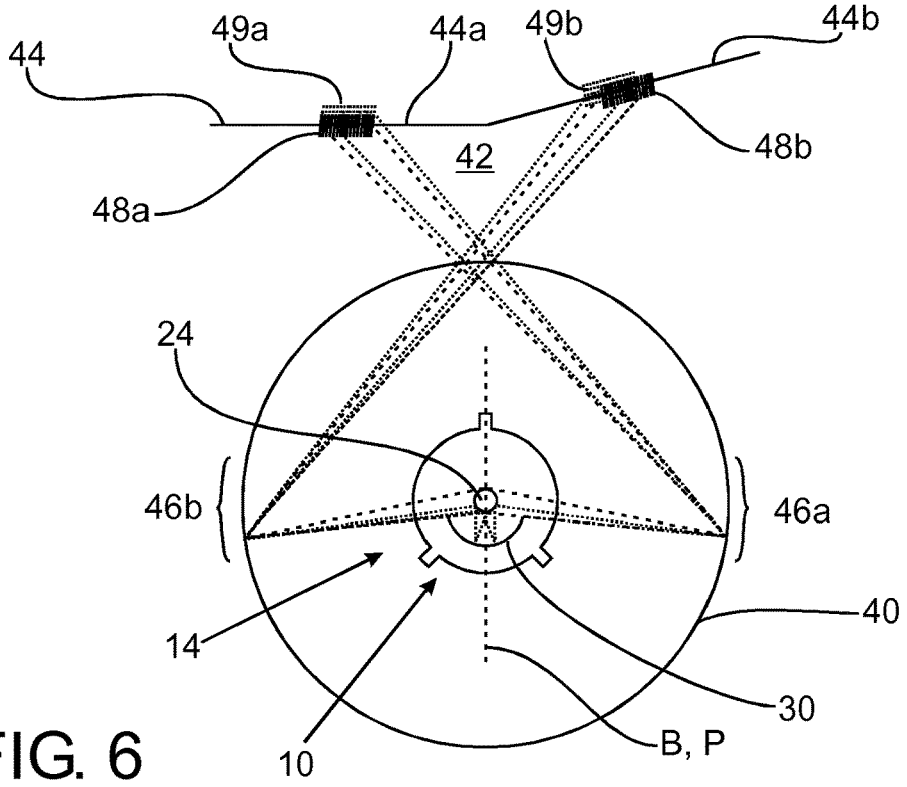
FIG. 6, 7*a*, 7*b* show schematical representations of arrangements of a lamp within a reflector.

FIG. 6, 7*a*, 7*b* schematically show arrangements of the lamp 10 within the reflector 40. The lower half of the representations in FIG. 6, 7*a*, 7*b* should be understood as viewing along the longitudinal axis L from the back of the headlight (i.e. from the right in FIG. 5). In the upper half of the representations in FIG. 6, 7*a*, 7*b*, the resulting illumination beam 42 with bright/dark boundary 44 is depicted. As the skilled person will understand, the schematical drawings FIG. 6, 7*a*, 7*b* serve to illustrate which portions of the lamp 10 and reflector 40 are responsible for creating different parts of the illumination beam 42.

In FIG. 6, the lamp 10 is arranged within the reflector 40 in upright position, i.e. with the baffle and protrusion symmetry axes B, P oriented vertically, corresponding to a rotation angle of 0°.

Figure 9A:
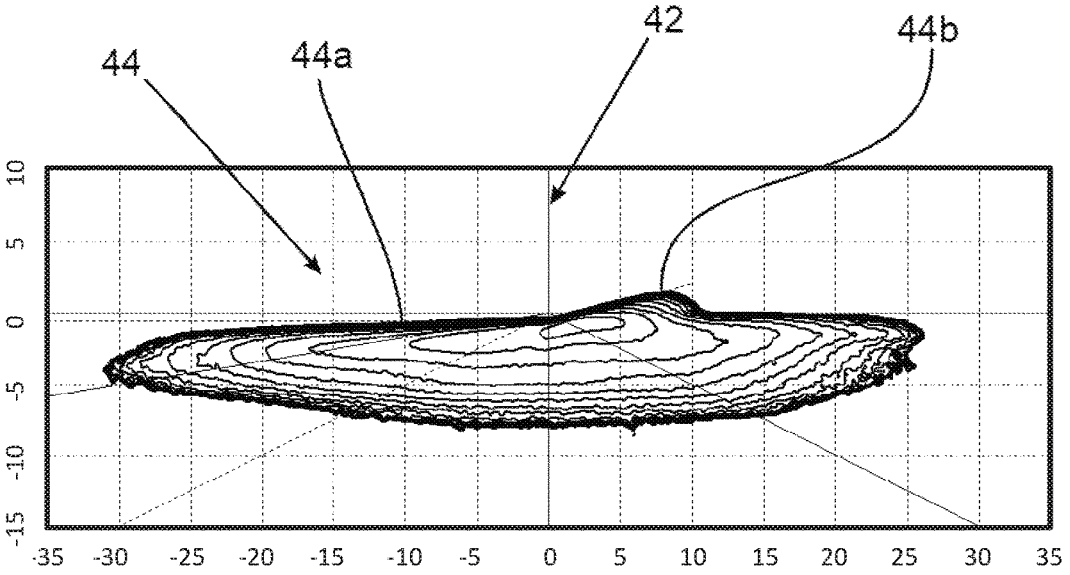
FIG. 9*a*, 9*b* show intensity distributions of illumination beams for different rotational positions of a lamp within a reflector.

As schematically shown in FIG. 6, light from the first filament 24 is reflected at the reflector surface to form the illumination beam 42. An intensity distribution of the illumination beam 42 for the upright oriented lamp 10 as shown in FIG. 6 is depicted in FIG. 9*a*. As schematically indicated in FIG. 6, the illumination beam 42 is a low beam including a bright/dark cut-off 44 including a horizontal portion 44*a* and a 15° inclined portion 44*b*.

As schematically indicated in FIG. 6, portions 46*a* to the right of the reflector 40 arranged at least substantially horizontal relative to the first filament 24 reflect light from this filament into regions at and below the horizontal portion 44*a* of the bright/dark cut-off 44 of the illumination beam 42, whereas portions 46*b* of the reflector 40 located on the opposite left side at least substantially horizontally reflect light from the first filament 24 to or below the inclined portion 44*b* of the bright/dark cut-off 44.

As schematically shown in FIG. 6, a first reflector surface segment 46*a* located at the right side of a reflector 40 reflects light from the filament 24 to project a horizontal image 48*a* of the first filament 24. A second reflecting segment 46*b* located to the left of the reflector 40 projects an image 48*b* of the first filament 24 which is inclined by the inclination angle $\alpha$ of 15°. The respective rays are schematically shown as dashed lines.

Figure 8A:
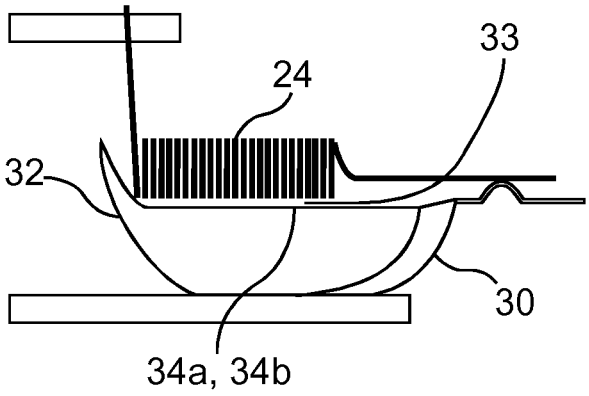
FIGS. 8*a*-8*c* show horizontal views of a portion of the burner of a lamp for different rotational positions.

FIG. 8*a* shows, for a horizontally symmetrical arrangement of the lamp 10, the appearance of the first filament 24 and the baffle 30 with upper side edges 34*a*, 34*b* as viewed from both horizontal reflector portions 46*a*, 46*b*. From both directions, the first filament 24 is fully visible and the respective upper side edge 34*a*, 34*b* is arranged below the lower side of the first filament 24 with a certain distance, such that a gap 33 is visible between the upper side edges 34*a*, 34*b* and the first filament 24.

As the inventors have observed, stray light, shown symbolically as dotted lines in FIG. 6, is also emitted from the burner 14 of the lamp 10. Such stray portions of light may be due e.g. to reflection of light at the baffle 30. The stray light leads to slightly dislocated images 49*a*, 49*b* along the bright/dark cut-off line 44. In particular, the stray portions of light forming images 49*b* above the inclined portion 44*b* of the bright/dark cut-off line 44 can lead to glare for oncoming traffic.

Figure 7A:
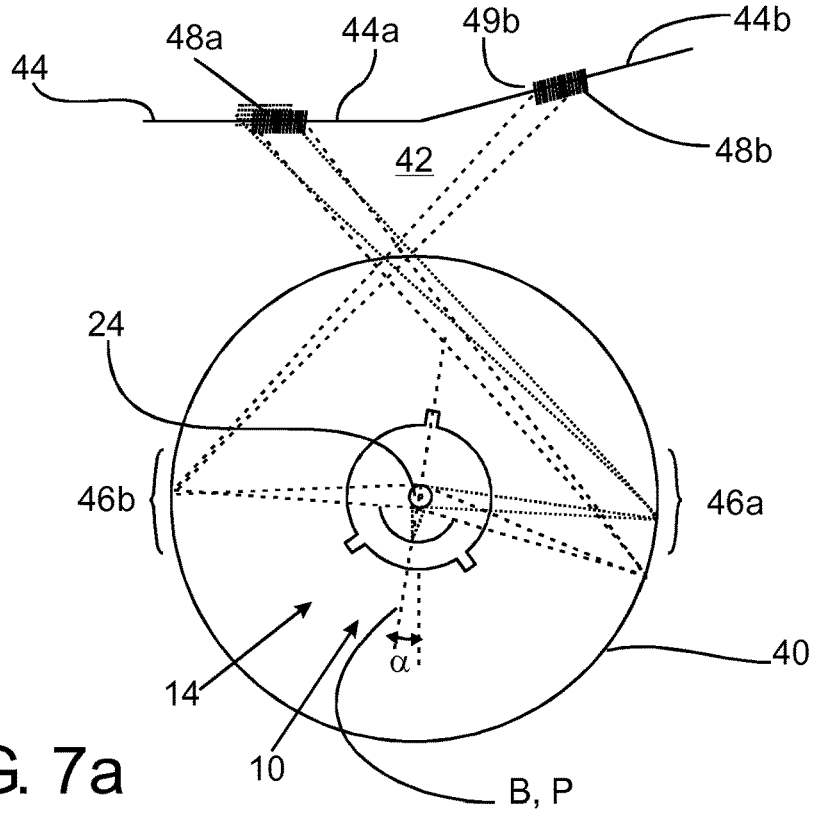

FIG. 7*a* shows a different, slightly rotated arrangement of the lamp 10. The lamp 10 is rotated relatively to the reflector 40 in clockwise direction, i.e. to the right in FIG. 7*a* by a rotation angle α of about 15°. Consequently, the symmetry axes B, P are arranged under the rotation angle α relative to the vertical axis.

Figure 8B:
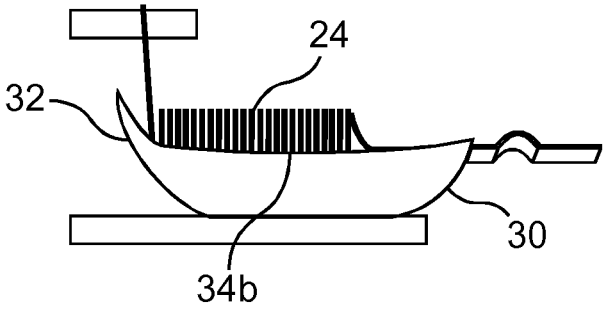
Figure 8C:
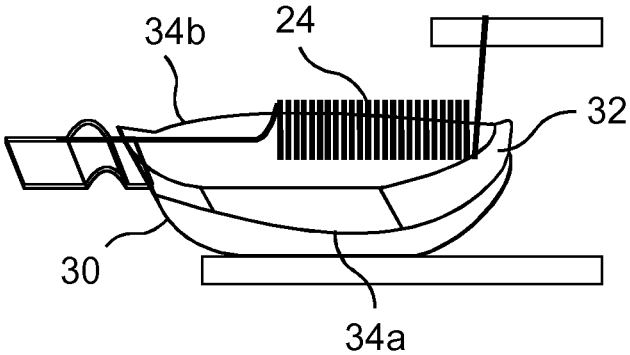

Due to the rotated and thus non-symmetrical arrangement of the lamp 10 within the reflector 40, the appearance of a first filament 24 differs as viewed from the horizontal left and right reflector segments 46*b*, 46*a*. FIG. 8*b* shows the appearance of the first filament 24 viewed from the left reflector side in FIG. 7*a*. Due to the rotation of the lamp 10, the upper side edge 34*b* of the baffle 30 has been raised relative to the first filament 24, such that the gap 33 below the filament 24 is no longer visible and the filament 24 is partially shielded. Viewed from the opposite right side as shown in FIG. 8*c*, the upper side edge 34*a* on the other side is lowered due to the rotation, such that the distance between the lower side of the first filament 24 and the upper side edge 34*b* of the baffle 30 is increased. From the right horizontal reflector portion 46*a*, the first filament 24 is fully visible and not shielded by the baffle 30.

As illustrated in FIG. 7*a*, this eliminates a substantial portion of stray light emitted into the horizontal direction of the second reflector surface segment 46*b*, shown to the left in FIG. 7*a*. Consequently, a stray light image 49*b*, which would appear at or even above the inclined portion 44*b* of the bright/dark cut-off line 44 (see FIG. 6), is eliminated.

Next to the horizontal portion 44*a* of the bright/dark cut-off 44, stray light (shown as dotted lines) may still create a stray image 49*a*. However, this portion of the bright/dark cut-off 44 of the illumination beam 42 is less critical with regard to glare for oncoming traffic.

Figure 7B:
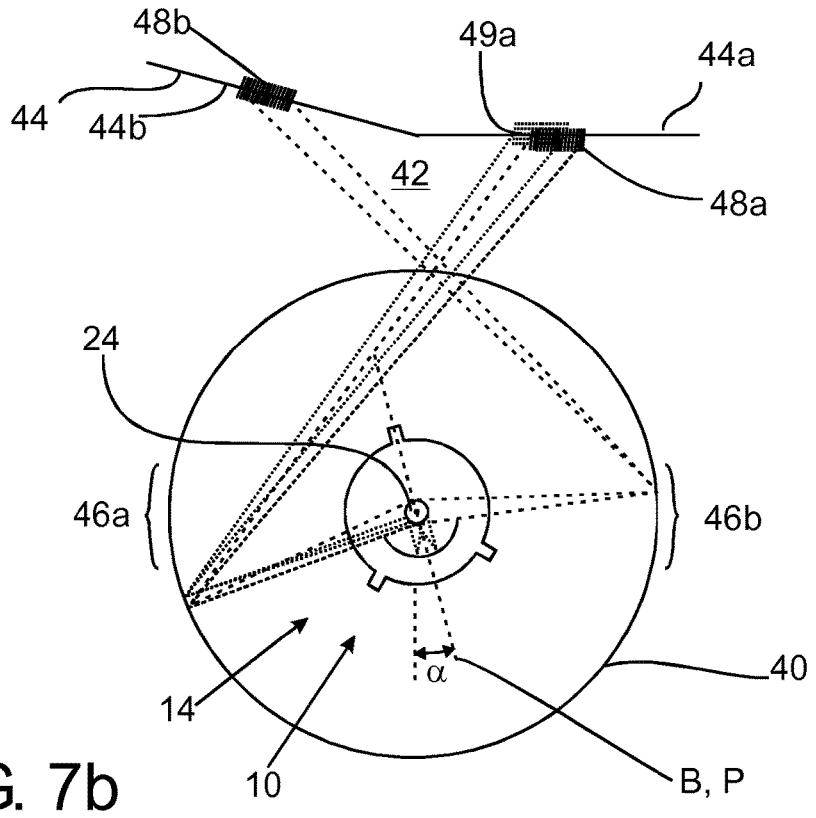

While in the schematic representation in FIG. 7*a* the shape of the bright/dark cut-off 44 is shown for countries with right-hand traffic, FIG. 7*b* shows the bright/dark cut-off 44 for left-hand traffic. The horizontal portion 44*a* and inclined portion 44*b* are arranged on opposite sides as compared to FIG. 7*a*. Consequently, the lamp 10 is arranged rotated in counter-clockwise direction for a rotation angle α of about 15°, i.e. to the left in FIG. 7*b*. In the resulting illumination beam 42, the projected image 48*b* of the filament 24 positioned at the inclined portion 44*b* is clear without stray light, whereas a stray light image 49*a* may still be present at the horizontal portion 44*a* of the illumination beam 42.

Figure 9B:
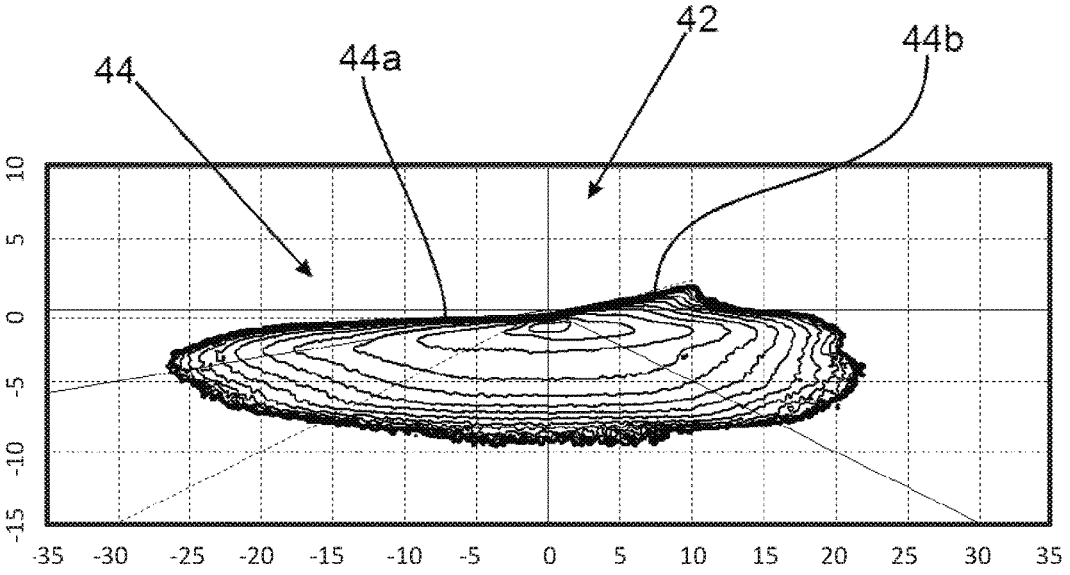

FIG. 9*b* shows an intensity distribution for the illumination beam 42 generated by a lamp 10 rotated within the reflector 40 by a clockwise rotation angle α of 15° (as shown in FIG. 7*a*).

While the invention has been illustrated and described in detail in the drawings and foregoing description, such illustration and description are to be considered illustrative or exemplary and not restrictive; the invention is not limited to the disclosed embodiments.

For example, the specific shape of the baffle 30 and the relative arrangement to the first filament 24 may differ in different embodiments. The lamp 10 may be arranged within the reflector 40 under different rotation angles α.

These and other variations of the disclosed embodiments can be understood and effected by those skilled in the art in practicing the claimed invention, from a study of the drawings, the disclosure and the appended claims.

In the claims, any reference signs place between parentheses shall not be construed as limiting the claim. The word "comprising" does not exclude the presence of elements or steps other than those listed in the claim. The word "a" or "an" preceding an element does not exclude the presence of a plurality of such elements. The mere fact that certain measures are recited in mutually different dependent claims does not indicate that a combination of these measures cannot be used to advantage.

The invention claimed is:

1. A headlight for a vehicle, comprising:

a concave reflector and a lamp arranged within the aid reflector to reflect light from the lamp to create an illumination beam with a bright/dark boundary, the lamp comprising a transparent vessel including a longitudinal axis, at least a first and a second filament arranged within the vessel, a baffle arranged proximate to the first filament, characterized by the baffle comprising first and second upper side edges, the first filament being arranged above a first plane including the upper side edges, wherein in a second plane through a center of the first filament, the second plane being arranged perpendicular to the longitudinal axis, the upper side edges are arranged symmetrically to a baffle symmetry axis extending from the center of the first filament centrally between the upper side edges, the lamp being arranged within the reflector rotated around the longitudinal axis by a rotation angle of 2°-20°.

2. The headlight according to claim 1, wherein the lamp is arranged within the reflector such that the baffle symmetry axis is arranged at the aid rotation angle relative to a vertical axis.

3. The headlight according to claim 1, wherein the rotation angle is 6°-18°.

4. The headlight according to claim 1, wherein the lamp comprises a base with radially extending positioning protrusions, the positioning protrusions being arranged symmetrically relative to a protrusion symmetry axis arranged parallel to the baffle symmetry axis.

5. The headlight according to claim 1, wherein the reflector is a complex shape reflector comprising a plurality of reflecting segments arranged to project images of at least one of the filaments.

6. The headlight according to claim 1, wherein the lamp is arranged in the reflector such that viewed in horizontal direction from a first side of the first filament is at least partially shielded by the first upper side edge of the baffle, and viewed in opposite horizontal direction from a second, opposite side the second upper side edge of the baffle is arranged not to shield the first filament.

7. The headlight according to claim 1, wherein the reflector comprises a first reflecting segment on a first side arranged in at least substantially horizontal direction from first filament, the first reflecting segment being arranged to reflect light from the first filament to a horizontal portion of the bright/dark boundary of the illumination beam.

8. The headlight according to claim 7, wherein the first reflecting segment is shaped to have a focus located on the first filament.

9. The headlight according to claim 1, wherein the reflector comprises a second reflecting segment on a second side arranged in at least substantially horizontal direction from the first filament, the second reflecting segment being arranged to reflect light from the first filament to an inclined portion of the bright/dark boundary of illumination beam.

10. The headlight according to claim 9, wherein the said second reflecting segment is shaped to have a focus located on thud first upper edge.

11. The headlight according to claim 1, wherein the first and second filaments are disposed to operate at an electrical power of more than 60 W each at a supplied voltage of 13.2 V.

12. The reflector for the headlight according to claim 1, comprising:

a concave reflector surface forming an inner reflector space, an opening for arrangement of the lamp with positioning protrusions, receiving portions for positioning protrusions located such that lamp is arranged within reflector at a rotation angle of 2°-20°.

13. A method of forming an illumination beam with a bright/dark boundary for a vehicle, comprising:

arranging a lamp within a concave reflector such that light emitted from the lamp creates the illumination beam, the lamp comprising a transparent vessel including a longitudinal axis, at least a first and a second filament arranged within the vessel, a baffle arranged proximate to the first filament, characterized by the baffle comprising first and second upper side edges, the first filament being arranged above a first plane including the upper side edges, wherein in a second plane through a center of the first filament, the second plane being arranged perpendicular to the longitudinal axis, the upper side edges are arranged symmetrically to a baffle symmetry axis extending from the id center of the id first filament centrally between the upper side edges, wherein the lamp is arranged within reflector rotated around the longitudinal axis by a rotation angle of 2°-20°.

* * * * *